United States Patent [19]

Lautenschläger

[11] 4,021,881

[45] May 10, 1977

[54] HINGE HOUSING FOR FURNITURE PIECES

[75] Inventor: Karl Lautenschläger, Reinheim, Germany

[73] Assignee: Karl Lautenschlager KG Mobelbeschlagfabrik, Reinheim, Germany

[22] Filed: Apr. 12, 1976

[21] Appl. No.: 676,027

[30] Foreign Application Priority Data

Apr. 12, 1975 Germany ..... 2516083

[52] U.S. Cl. ..... 16/159

[51] Int. Cl.[2] ..... F05D 5/02

[58] Field of Search ..... 16/159, 149, 128 R, 16/137, 138, 171, 168

[56] References Cited

UNITED STATES PATENTS

| | | | |
|---|---|---|---|
| 481,044 | 8/1892 | Mottinger | 16/159 |
| 3,311,944 | 4/1967 | Dufek | 16/159 X |
| 3,686,709 | 8/1972 | Tuvert | 16/159 |
| 3,916,480 | 11/1975 | Smith | 16/159 |

*Primary Examiner*—G. V. Larkin
*Attorney, Agent, or Firm*—Allison C. Collard

[57] ABSTRACT

A housing for supporting furniture hinges and for insertion into a corresponding recess of a furniture piece consisting of a plug-in casing connected to a flange plate and a hollow plug-in pin. An eccentric part is pivotably mounted within the plug-in pin and has an eccentric segment which is in contact with a flat locking member disposed in the housing. The locking member has a pair of locking arms which are offset from the plane of the body of the locking member. The peripheral edges of these arms are beveled to form cutters and arranged so that when the housing is inserted in the recess of a furniture piece, and the eccentric part is pivoted, the cutters will draw the casing into the corresponding furniture recess. In another embodiment, the plug-in casing is provided with a bearing pin to guide the locking arms in the casing slots. The bearing pin is also the bearing axis of the hinge guide.

14 Claims, 11 Drawing Figures

HINGE HOUSING FOR FURNITURE PIECES

The present invention relates to a housing for furniture hinges with a plug-in casing for receiving the pivot point for the hinges, and which is connected with a cover plate and a plug-in pin.

When possible, furniture is delivered in a disassembled manner and assembled at the customer's site, so as to save transportation space. However, the hinges which are used for pivotably mounting the doors of furniture pieces are already mounted onto the doors in the furniture factory, so as to simplify and accelerate the assembly at a later point. The doors which are provided with the hinges are shipped in packages and it is possible that the mounted hinges can be easily damaged, particularly if the support or carrier arms extend laterally from the packages. On the other hand, the extending or protruding support arms may cause other types of damage.

In a prior German application of the applicant (P 24 57 022.7), the protrusion of the support arms of the pre-mounted hinge portions from the door packages is prevented. In this case, the door engaging part for the pivotable pivot point of the support arm, which is usually mounted in a hinged housing in a recessed position in corresponding recesses of the door, consists of two parts, namely, an outer jacket part, and a pivotable hinge support mounted in the outer jacket part. For transportation purposes, the hinge support is folded outwardly by about 90° from the jacket portion with respect to its defined position when the furniture piece is assembled so that the support arm in the door locking position is disposed parallel with respect to the inner side and the edge of the door. The support arm therefore does not extend over the door edges. When assembling the furniture pieces, it is sufficient to fold back the hinge support into the jacket part, in order to restore the "in use" position of the support arm. These hinges are accepted and proven, and are in ever increasing demand. However, the individual doors cannot be packaged in a tight relationship with respect to each other due to the folded out hinge supports. A corresponding space must be maintained between the doors, which corresponds to the relatively small width of the hinge supports. This space between the doors must be secured, at least within the range of the hinges by means of packaging material, such as cardboard or polystyrene foam pieces, so that the outwardly folded hinge parts do not scratch or damage the next succeeding door in the door package. Therefore, tight packaging of the doors is possible if the doors can be packaged immediately on top of each other without having the premounted hinge housings thereon. In this case, however, the doors must be assembled at the site of the customer, which consumes both time and work, and increases the risk of damage to the hinges or to the furniture pieces due to careless assembly. The housings of the conventional hinges are known as push-in or drive-in housings which have a certain excess measurement or projection with respect to the recess which is milled or cut into the door. If the housing has a lower measurement or if the cut in the door is too large, the housing has a loose fitting, so that additional securement by means of screws has to be provided. If the dimensions of the housing are too large, or if the cut in the door is too small, there is a risk that the door will break since most doors are presently made from pressboard material. There is also the danger that the housing will break during mounting in view of the force needed to drive or push the housing into the recess.

Therefore, it is an object of the invention to provide a hinge housing which can be mounted quickly and simply without any difficulty by untrained personnel when the corresponding furniture piece is assembled so that the doors may be inserted into door packages without premounted hinge parts in a minimum of space and with the least amount of risk of damage. Thus, after the hinges are mounted, they should be absolutely safe and support a heavy load, so that there is a safety of operation assured during the total life of the furniture piece. Moreover, the hinges should also be demountable in special situations.

For a hinge of the above-mentioned type, this object of the invention is obtained in that the plug-in pin is hollow, and a structural eccentric part is pivotably mounted within the hollow plug-in pin. An eccentric segment engages a flat locking member which is displaceable parallel with respect to the plane of cover plates, and which displaces the same through its pivot position from a rest, into a locking position for retraction into the outer measurements of the housing. The locking member protrudes partly from the housing and penetrates into the material of the furniture piece which surrounds the housing. Thus, the housing is positively locked with the door, which is connected with the hinge in its corresponding recess without having an excess measurement or projection which would make the mounting of the housing more difficult as is known from the conventional forced locked housings.

In a preferred embodiment of the invention, the plug-in pin is slotted in the longitudinal direction in known manner and the structural eccentric part is provided with a cam section or segment which when turned or pivoted, spreads the pin portions which are separated by a slot, and which act like a straddling dowel. The arrangement of the cam section on the structural eccentric part is such that the spreading action by the cam section is carried out simultaneously and in the same direction with the displacement of the locking member by the eccentric section. Therefore, in addition to the positive locking of the hinge housing in the door by means of the locking element, the plug-in pin is spread apart, so that a permanent fixed and play-free seating of the housing is additionally assured.

In addition, the structural eccentric part may be provided with a locking segment in addition to the eccentric segment and cam segment, so that the locking segment in its rest position is located in the hollow space of the plug-in pin. In the locking position, this locking segment extends through one of the slots of the plug-in pin and penetrates into the material surrounding the pin. Thus, the structural eccentric part not only provides for the displacement of the locking member, but in addition, carries out a direct locking function.

Preferably, the structural eccentric part is inserted into the plug-in pin through an opening in the flange plate, so that this opening is in connection with the hollow space of the plug-in pin. The structural eccentric part is rotatably or pivotably mounted in the opening. In addition, a second bearing or support on the inner end of the structural eccentric part may be provided. This preferably is a pin provided at the end of the structural eccentric part which protrudes somewhat from the plug-in pin, and is mounted in a complementary bearing recess mounted on the bottom recess for the plug-in pin for the furniture part which is to be provided with the hinge housing. In order to prevent the structural eccentric part from being pivoted beyond the defined limits, and to prevent an accidental retraction of the locking member, a plurality of abutment surfaces are provided on the structural eccentric part and the flange plate. These limit the required pivot angle of the eccentric segment during the pivot movement of the structural eccentric part for moving the locking member from the rest position into the locking position.

The plug-in pin is separated into two pin portions by means of a slot which runs centrally and in a symmetric plane in the housing. The width of the slot is formed so that the remaining pin parts are sufficiently elastic, so as to be spread or straddled apart by the cam segment during the turning or pivoting of the structural eccentric part. Furthermore, the locking segment of the structural eccentric part exits from this slot in the locking position.

Thereby the abutment surfaces on the structural eccentric part and the flange plates are arranged so that the pivot angle of the structural eccentric parts is limited to a 90° angle.

In the preferred embodiment of the invention, the locking element is a fork-like stamped out sheet metal part. The free ends of the locking arms penetrate into the material which surround the plug-in casing in the locking position. The locking arms are guided in outer slots of the plug-in casing. In the connecting part of the locking member which connects the locking arms, an opening or aperture is provided which surrounds the plug-in pin. The opening is provided with engagement surfaces which protrude into a slot of the plug-in pin, whereby the eccentric segment of the structural eccentric part engages the engagement surfaces.

The locking arms of the locking element are offset heightwise at their front portions. They are guided in the slots of the plug-in casing by a double bend with respect to the plane of the locked part of the locking member which is provided with the opening. Thus, it is possible to guide the locking member in the area of the plug-in pin immediately beneath or in a recess of the flange plate, respectively, so that no additional recess has to be cut into the furniture piece for the locking member.

The limiting edges of the free ends of the locking arms of the locking element are sharpened by a bevel into cutters. The bevel runs in a manner wherein the cutters which cut into the material surrounding the plug-in casing draw the casing into the corresponding recess of the furniture piece by generating the necessary force components.

The assembly of the locking member on the housing is aided in that the lower limits of the slots which guide the locking arms of the locking elements are formed by the outermost end ranges of a pin which laterally extends through said housing. The pin simultaneously provides the bearing axis of a hinge guide.

At the opposite side of the exit opening of the locking arms from their associated slots of the plug-in casing, a sharpened shoulder is provided. This position is forced into the recess wall due to the reaction forces generated in the material surrounding the plug-in casing during the insertion of the locking arms.

Other objects and features of the present invention will become apparent from the following detailed description when taken in connection with the accompanying drawings. It is to be understood, however, that the drawings are designed for the purposes of illustration only and are not intended as a definition of the limits and scope of the invention.

In the drawings, wherein similar reference numerals denote similar elements throughout the several views:

FIG. 1 is a partial sectioned side view of a hinge housing in accordance with the invention, provided with a locking member displaceable by a structural eccentric part;

FIGS. 2, 3 and 4 show the hinge housing of FIG. 1 and the locking element in a plan view and a sectional view taken along line 3—3 and 4—4, respectively of FIG. 2;

Figure 1:
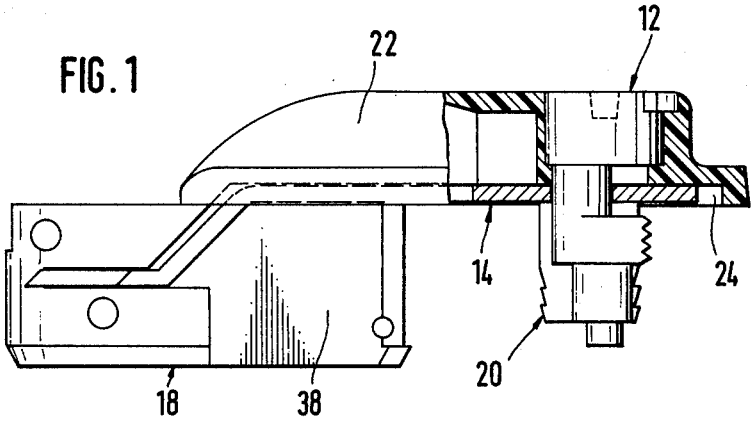
Figure 2:
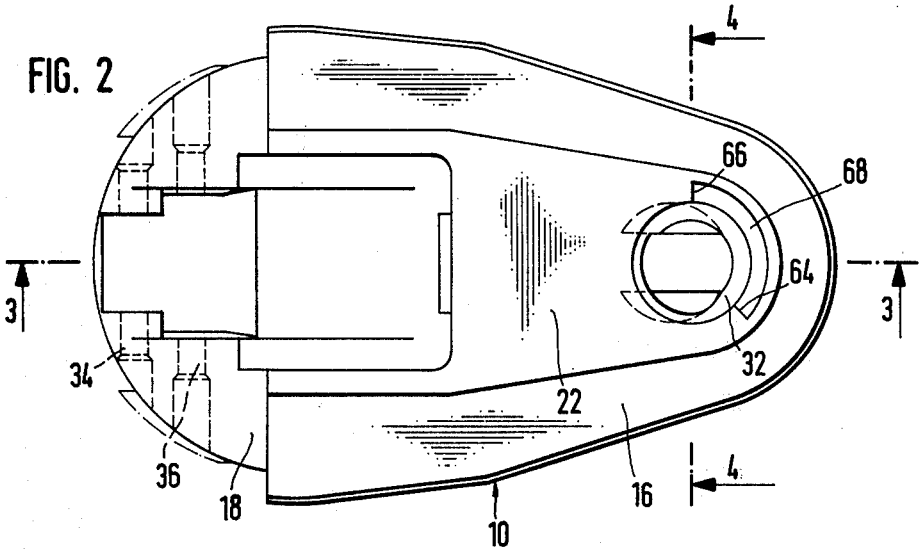
Figure 3:
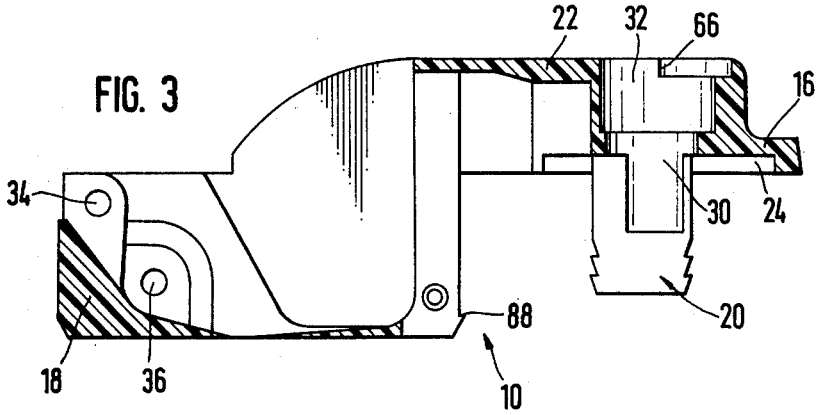
Figure 4:
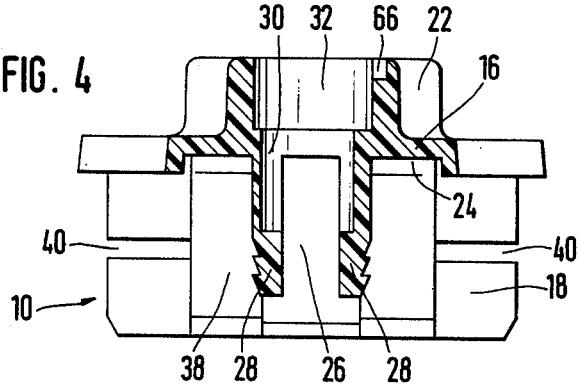

Referring to FIG. 1, there is shown a first embodiment of the inventive hinge housing which essentially consists of housing 10 and is described in more detail in connection with FIGS. 2–4, a structural eccentric part 12 (FIGS. 5–7) which is pivotably mounted at a defined angle in this housing, and a locking element 14 (FIGS. 8 and 9) which is displaceable by pivoting the structural eccentric part 12.

Housing 10, which may be made from injection molded plastic, essentially consists of a flange plate 16 connected to a plug-in casing 18, and a plug-in pin 20. The plug-in casing and the plug-in pin may be completely inserted into corresponding recesses of a furniture piece which is to be provided with housing 10, so that the flange plate engages the furniture piece with its back side.

In this embodiment, flange plate 16 is provided with an arched section 22 in the range between the plug-in casing 18 and the plug-in pin 20. A spring may be provided with arched section 22 which pretensions a pivot or fulcrum pressure member within the plug-in casing which elastically locks the support arm in its locked position when the hinge is finally mounted. However, this type of snap lock is not essential for the subject invention, so that the same will not be explained in detail in connection with the invention.

Flange plate 16 is provided with a flat recess 24 (FIGS. 3 and 4) at the lower side thereof which receives and guides a section or segment of locking member 14. Hollow plug-in pin 20 is separated into two pin portions 28 (FIG. 4) by means of a relatively wide slot 26. The inner space 30 which is formed by these two pin portions is accessible from the outside by an opening 32 in flange plate 16. The structural eccentric part 12 is pivotably mounted in this substantially cylindrical opening, as will be described in detail at a later time.

The open plug-in casing 18 which is open at its upper side and which is connected with flange plate 16 receives in known manner the inner ends of hinge guides which are supported on axes (not shown) which are inserted into bores 34 and 36 (FIG. 3) which extend through the walls of plug-in casing 18. In the shown embodiment, the plug-in casing has a shape which deviates from the normally shown circular cross section shape in that in the range facing the plug-in pin 20, lateral outer segments are cut off about half way to the plug-in casing, wherein a reduced central section (segment) 38 remains, e.g., reduced at its width. In about half of the height of the outer non cut off part of the plug-in casing 18 horizontally running slots 40 are formed (provided) which run to the outside, wherein the locking arms 42 of the locking element 14 are guided, which will be described in more detail in connection with FIGS. 8 and 9.

Figure 5:
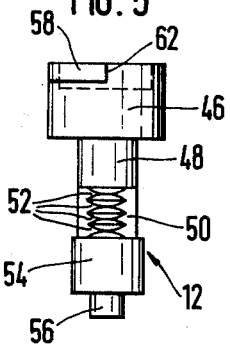
FIGS. 5, 6 and 7 show the structural eccentric part for displacing the locking member in front view, side view, and plan view.
Figure 6:
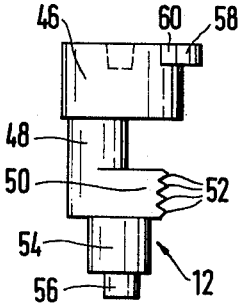
Figure 7:
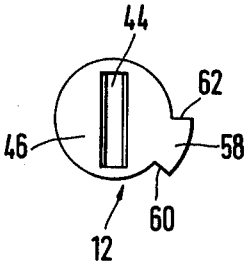

The structural eccentric part 12 shown in FIGS. 5–7 which can be introduced through opening 32 of hinge housing 10 into the inner space 34 of plug-in pin 20, consists essentially of four successive individual segments having different functions. Head 46 which is rotatably mounted at opening 32, and which is provided with a slot-like recess 44 for receiving a screw driver, is followed by the eccentric segment 48 which is offset with respect to the rotational axis of head 46. The relative position of the eccentric segment within the plug-in pin is defined by the rotating movement of head 46. Adjacent to eccentric segment 48 is a locking segment 50 which is also eccentrically offset with respect to the rotational axis of head 46, but in an opposite direction with respect to the eccentric segment 48. A plurality of sharpened teeth 52 are provided on locking segment 50 which extend from slot 26 of the plug-in pin 20 when in a locking position. Teeth 52 penetrate into the walls of the bore which receives pin 20.

Beneath locking segment 50 is a cross sectional elliptical or longitudinally oval cam section 54 which provides for straddling the pin portion 28 in the locking position. Cam segment 54 is located centrically on the rotational axis of head 46, whereby the arrangement of the elliptical cross section is such that the longer main axis of the ellipse in the rest of the structural eccentric part runs in the direction of slot 26. The width of cam segment 54 which is measured across the shorter main axis of the ellipse corresponds to the width of slot 26. The cross sectional circular bearing pin 56, shown in FIGS. 5 and 6 may be mounted beneath the cam segment 54. The bearing pin already extends or protrudes from plug-in pin 20 and forms in cooperation with a complementary bore in the bottom a second rotating bearing for the structural eccentric part 12, whereby this bore is defined for receiving plug-in pin 20. However, bearing pin 56 may be deleted altogether. The support of eccentric part 12 is exclusively provided at the circumference of head 46 of part 12 which is inserted into opening 32 of housing 10.

To limit the pivot angle of the eccentric part on the required movement path of eccentric segment 48, head 46 is provided with an abutment segment 58. This segment has radially running limited surfaces or abutment surfaces 60 and 62 which cooperate with abutment surfaces 64 and 66 which are provided on the ends of a recess 68 provided in opening 32 of housing 10. The pivot axis of the eccentric part 12 is thus limited to a 90° angle with respect to the straddle function of cam segment 54 in the shown embodiment due to recess 68. However, larger pivot angles up to 180° can be realized if desirable, with respect to the function of the eccentric segment 48 or the locking segment 50, respectively.

Figure 8:
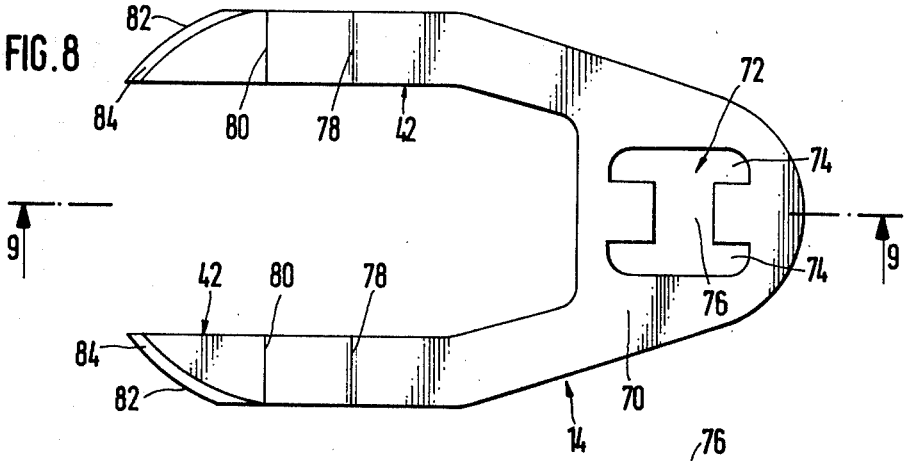
FIGS. 8 and 9 are a plan view onto the actuated locking member of the inventive hinge housing by the structural eccentric part of FIGS. 5–7, as well as a sectional view of the same seen in direction of arrows 9—9 in FIG. 8.
Figure 9:
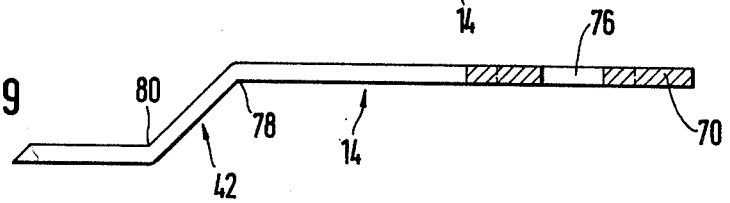

As can be seen from FIGS. 8 and 9, locking element 14 is shown which is actuated by structural eccentric part 12, and is made from a sufficiently strong stamped out piece of sheet metal. Locking member 14 is provided with a rib surface 70 having a characteristic H-shaped opening 72, as can be seen from FIG. 9. The two locking arms 42 are spaced apart from each other but protrude in the same direction from rib surface 70, so that in the plan view, the locking member has the shape of a two pronged fork. The two outer longitudinally extending slot-like segments 74 of the H-shaped opening 72 are mounted or slid over the free ends of pin portions 28 of plug-in pin 20 until rib surface 70 engages flange plate 16 within recess 24 (see FIG. 1). The slot-like segments 74 are so measured that the locking member may be displaced in the direction of locking arms 42 to a defined path. This displacement is effected by eccentric segment 48 of eccentric part 12 which is located in segments 74 and the connecting segment 76 of opening 72. As can be seen in FIG. 9, locking arms 42 are distorted or offset in a counter direction at 78 and 80 so that their free associated ends 82 are provided at the height of slots 40 (FIG. 4) in housing 10 when they are mounted and are guided in these slots. Ends 82 have a round shape which corresponds to the radius of the plug-in head 18 and are sharpened by bevels into cutters 84. Thus, the lengths of locking arms 42 are measured so that cutters 84 are retracted into the slots in the rest position of the eccentric part 12 so that they do not protrude from the plug-in casing 18. When eccentric part 12 is pivoted into the locking position, eccentric segment 48 moves locking member 14 through slots 40, so that cutters 84 penetrate into the walls of the recess which receives plug-in casing 18. Due to the downwardly directed inclination or bevel of cutters 84, the plug-in casing is drawn into the recess when the cutters penetrate into the material of the furniture piece, so that flange plate 16 is positively pressed against the corresponding surface of the furniture piece under pretension. Simultaneously, the pivoting of the structural eccentric part 12 causes teeth 52 of locking segment 50 to exit from slot 26 of plug-in pin 20 and pin portions 28 are straddled apart by cam segment 54 causing plug-in pin 20 to be securely mounted in the corresponding recess of the furniture piece. Furthermore, a sharpened protruding portion 88 which is mounted on the opposite side of plug-in casing 18 from exit location of locking arms 42 also provides for a secure mounting of hinge housing 10.

Figure 10:
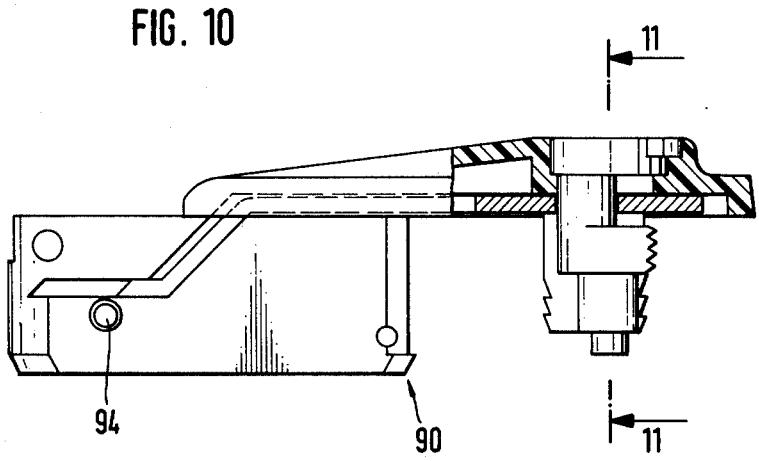
FIG. 10 shows a corresponding further embodiment of the invention as shown in FIG. 1.
Figure 11:
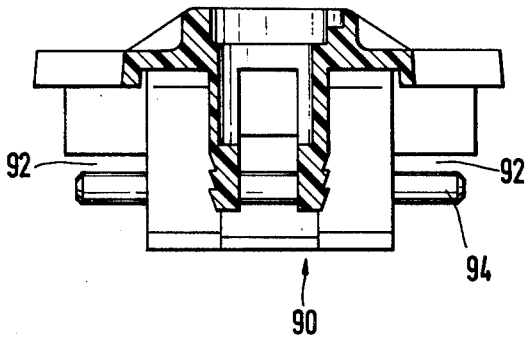
FIG. 11 is a sectional view taken along line 11—11 of FIG. 10 and corresponding to FIG. 4, whereby the structural eccentric part and the locking element is omitted to provide a clearer view.

The embodiment of FIGS. 10 and 11 shows that the snap locking in form of a spring pretensioned pressure piece may be omitted. This snap locking means is shown in accordance with the embodiment of FIGS. 1–4. Therefore in housing 90, the arched section 22 for receiving the spring is deleted, so that this portion of the housing which protrudes over the inner side of the door may be made flatter. Hence, head 46 may also be constructed flatter, whereby eccentric part 12 remains unchanged.

The essential difference is that the lower limit of slots 92 which correspond to slots 40 of housing 10 are defined by a pin 94, which simultaneously forms the bearing axis for the outer or upper guide (not shown) for the hinge. Therefore, the parts of the plug-in casing 18 beneath slots 40 as shown in FIG. 4 may also be deleted, i.e., up to the width of the central portion (section) 38. Besides saving material, the assembly of locking element 14 is also facilitated in that it is merely slid onto the lower housing side before pin 94 is mounted. As soon as the hinge guides are mounted, pin 94 is pressed into theplug-in casing 18, and as soon as the outer regions engage underneath locking arms 42, locking element 14 is fixedly mounted on housing 90.

While only a few embodiments of the present invention have been shown and described, it will be obvious to those skilled in the art that many changes and modifications may be made thereunto without departing from the spirit and scope of the invention.

What is claimed is:

1. In a housing for supporting furniture hinges in the material of a furniture piece having a plug-in casing connected with a flange plate and a plug-in pin wherein the pivot point for the hinges is provided, the improvement comprising a hollow plug-in pin, an eccentric part pivotably mounted within said hollow plug-in pin, said eccentric part having an eccentric segment, a flat locking member which is displaceable parallel with respect to the plane of the flange plate said eccentric segment engaging said flat locking member for displacing the locking member in response to the pivoting of said eccentric part from a rest position into a locking position, so that the locking member is retracted into the outer periphery of the flange plate housing, wherein it protrudes partly from the housing and penetrates into the material of the furniture piece which surrounds the housing.

2. The housing according to claim 1 wherein said plug-in pin is slotted in the longitudinal direction of the pin to form at least two pin portions separated by a slot, and said eccentric part is provided with a cam segment which when pivoted spreads said pin portions so that the pin serves as a straddling dowel, the arrangement of said cam segment on said eccentric part being orientated such that the spreading action by said cam segment is carried out simultaneously and in the same direction with the displacement of said locking member by said eccentric segment.

3. The housing according to claim 2 wherein said eccentric part includes a locking segment in addition to said eccentric and cam segments, whereby in its rest position, said locking segment is located in the hollow space of said plug-in pin, and in the locking position, said locking segment extends through the slot of said plug-in pin and penetrates into the material surrounding the pin.

4. The housing in accordance with claim 1 wherein said eccentric part is inserted into the plug-in pin through an opening in the flange plate, the opening being in connection with the hollow space of said plug-in pin, said eccentric part being rotatably mounted in said opening.

5. The housing in accordance with claim 4 comprising a bearing pin formed at the end of said eccentric part, said bearing pin protruding from said plug-in pin for insertion into a complementary bearing bore mounted on the bottom of the recess for plug-in pin formed in the furniture piece which is to be provided with said hinge housing.

6. The housing in accordance with claim 4 wherein said eccentric part includes abutment surfaces for limiting the pivot angle of said eccentric segment during the pivotal movement of the eccentric part for moving said locking member from the rest position into the locking position.

7. The housing according to claim 6 wherein said plug-in pin is separated into two pin portions by means of a slot which runs centrally and in a symmetric plane in said flange housing.

8. The housing according to claim 6 wherein said abutment surfaces on said eccentric part and said flange plate are arranged so that the pivot angle of the eccentric segment is limited to 90°.

9. The housing according to claim 1 wherein said locking member is fork-shaped defining locking arms whereby the free ends of said locking arms penetrate into the material which surrounds said plug-in casing in the locking position, said locking arms being guided in outer slots formed in said plug-in casing, said locking member having a connecting portion on one end opposite said locking arms, said connecting portion including an opening which surrounds said plug-in pin, said opening having engagement faces which protrude into the slot of said plug-in pin so that the eccentric segment of said eccentric part engages said engagement faces.

10. The housing according to claim 9 wherein the locking arms of said locking element are offset heightwise at their free end portions and are guided in the slots of said plug-in casing, said offset being a double bend with respect to the plane of said locking member which is provided with the opening.

11. The housing according to claim 9 wherein the peripheral edges of the free end portions of said locking arms are beveled and sharpened as cutters, the beveling being disposed so that the cutters which cut into the material surrounding the plug-in casing draw the casing into the corresponding recess of the furniture piece.

12. The housing according to claim 10 wherein the lower limitation of the plug-in casing slots which guide the locking arms of said locking element includes a bearing pin which laterally extends through said housing for contact with the offset portion of said arms.

13. The housing according to claim 12 wherein said pin comprises the bearing axis of a hinge guide.

14. The housing according to claim 13 comprising a sharpened shoulder disposed opposite to the exit opening of said locking arms from the slots of said plug-in casing.

* * * * *